United States Patent [19]

Fournier et al.

[11] 4,121,136

[45] Oct. 17, 1978

[54] APPARATUS FOR FEEDING DISCHARGE LAMPS FROM A DIRECT CURRENT SOURCE

[75] Inventors: Jean-Claude Fournier; Albert Hermitte, both of Toulon, France

[73] Assignee: Etat Francais, Paris, France

[21] Appl. No.: 796,483

[22] Filed: May 12, 1977

[30] Foreign Application Priority Data

May 18, 1976 [FR] France ..... 76 14881

[51] Int. Cl.[2] ..... H05B 41/36

[52] U.S. Cl. ..... 315/205; 315/208; 315/224; 315/287; 315/307; 315/DIG. 7

[58] Field of Search ..... 315/307, 287, DIG. 7, 315/205, 208, 209 R, 224, 308

[56] References Cited

U.S. PATENT DOCUMENTS

| | | | |
|---|---|---|---|
| 3,165,668 | 1/1965 | Harpley | 315/209 R |
| 3,222,572 | 12/1965 | Powell | 315/287 X |
| 3,913,002 | 10/1975 | Steigerwald et al. | 315/208 X |
| 3,919,592 | 11/1975 | Gray | 315/208 X |

*Primary Examiner*—Alfred E. Smith
*Assistant Examiner*—Charles F. Roberts
*Attorney, Agent, or Firm*—Haseltine, Lake & Waters

[57] ABSTRACT

Apparatus for feeding a discharge lamp such as a mercury vapor lamp mounted in series with a choke from a direct current source comprising a chopper of direct current including an electronic switch and a detector of current intensity mounted in series with the choke. A first comparator compares the intensity of the current to a maximum level for opening the switch when the maximum level is reached and a second comparator compares the intensity of the current to a minimum value for closing the switch when the minimum value is reached. The lamp choke and current detector are connected in series with one another and a diode is mounted in parallel therewith and is oriented in the direction to pass current from the negative terminal towards the positive terminal of the direct current source.

7 Claims, 3 Drawing Figures

APPARATUS FOR FEEDING DISCHARGE LAMPS FROM A DIRECT CURRENT SOURCE

FIELD OF THE INVENTION

The present invention relates to apparatus for feeding discharge lamps, for example, mercury vapor lamps from a direct current source and to lighting apparatus provided with this apparatus.

The technical field of the invention is that of the construction of lighting apparatus provided with discharge lamps fed from a direct current source.

A particular and non-limitative application of the invention is the feed of projectors placed at the exterior of underwater exploration vessels comprising an energy source constituted by a group of batteries.

BACKGROUND

Arc lamps or mercury vapor lamps, simple or doped, are generally fed by alternating current through a choke or ballast which limits the intensity of the current.

It is known that these lamps have a very high luminous output, much greater than incandescent lamps. However, projectors of self-contained small exploration vessels for underwater work which are fed by electrical energy by a group of batteries continue to be provided with incandescent lamps. Since these lamps are relatively powerful, for example, 400 watts, there is a rapid discharge of the batteries which limits the range of these vessels.

SUMMARY OF THE INVENTION

An object of the present invention is to provide lighting apparatus fed by a direct current source of limited capacity of the type comprising a group of batteries, in which the lighting apparatus is equipped with discharge lamps and the consumption of energy is reduced.

The feed of direct current to discharge lamps raises problems. In fact, a discharge lamp presents, after its energization, an arc voltage analogous to a counter-electromotive force whose magnitude, for constant intensity, increases in proportion to the heating of the lamp and assymptotically approaches a limit, which for example, for a simple mercury vapor lamp is of the order of 140 volts.

It is therefore necessary to control the intensity through the lamp. In fact, there is no self-regulation and if one directly connects a mercury vapor lamp to the terminals of a battery and produces energization, the lamp is immediately destroyed by the considerable current which traverses it.

One can easily transform direct current to alternating current by means of a converter and feed the alternating current to a discharge lamp of a projector through the intermediary of a ballast. This solution is objectionable, cumbersome and involves energy losses on the conversion from direct to alternating current, and also, losses due to the ballast which completely cancel the gain of luminous output which comes from the discharge lamp.

One can also seek to limit the voltage at the terminals of the lamp by placing a variable resistance in series therewith. This solution is not feasible because useless power is consumed in the resistance and it will not confer an automatic regulation of the intensity which flows through the lamp. If it can operate with simple mercury vapor lamps it cannot operate with doped lamps which are thus found at the limit of stability of the arc and which extinguish themselves.

The object of the invention is to resolve the problems posed by the fee of discharge lamps of such type so that one can feed them from a direct current source of limited capacity, for example, from a group of batteries while economizing, to a maximum, the energy consumed by the utilization of apparatus which is simple, unobjectionable and is compact for each lamp.

This objective is obtained by means of a feed apparatus comprising a chopper of direct current constituted as an electronic switch, a current detector and a choke mounted in series with each lamp; a first comparator which compares the intensity of the current to a maximum value and which directs the opening of the switch when the maximum value is attained and a second comparator which compares the intensity of the current to a minimum value and which directs the closure of the switch when this minimum value is attained.

The apparatus according to the invention additionally comprises a diode mounted in parallel with said lamp, said choke, and said current detects and the diode is oriented to pass current in the direction from the negative terminal towards the positive terminal of the direct current source.

The difference $\Delta i$ between the maximum and minimum values is less than the limit from which a stroboscopic effect would appear.

The invention provides a novel apparatus which is unobjectionable and compact and which constitutes a type of ballast associated with each discharge lamp and which permits connection thereof to a source of direct current of sufficient voltage.

An embodiment of the invention finds specific application in the feed of projectors for self-contained underwater exploration vessels not connected to the surface and provided with a group of batteries. The invention permits these projectors to be provided with discharge lamps, notably mercury vapor lamps, and to benefit from the excellent luminous output of these lamps without risk of explosion thereof.

Comparative tests on a mercury vapor lamp of 400 watts shows that it consumes between 40 and 50 watts in the ballast when the lamp is fed with alternating current whereas, with an arrangement according to the invention, the lost power is of the order of only 25 watts.

The luminous output of projectors with mercury vapor lamps fed by direct current by means of the apparatus according to the invention is clearly better than those of the same projectors provided with incandescent lamps by an order of magnitude of superiority of two to three times.

BRIEF DESCRIPTION OF THE DRAWINGS

The following description refers to the annexed drawings which show embodiments of the invention without limiting character.

DETAILED DESCRIPTION

Figure 1:
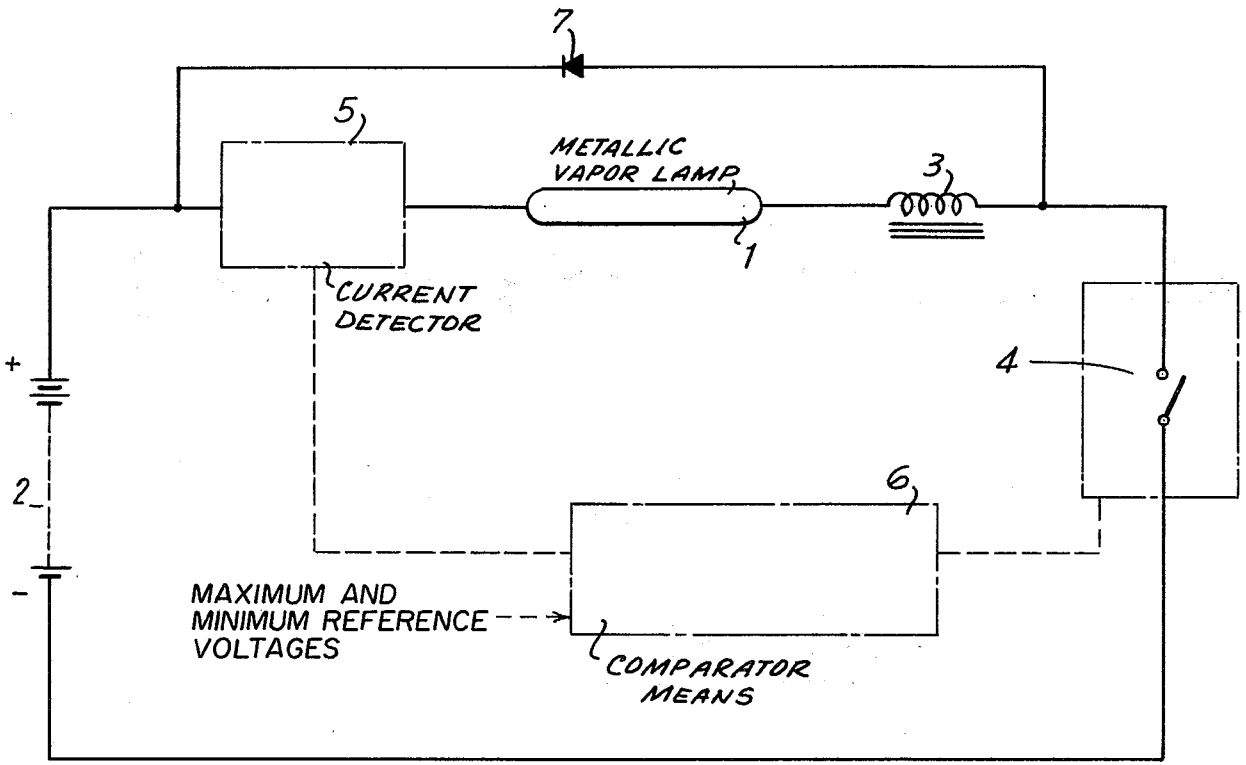
FIG. 1 is a schematic block diagram of apparatus according to the invention.

Referring to the drawing, FIG. 1 shows a metallic vapor lamp 1, for example, a mercury vapor lamp, which is part of a projector that is fed from a group of batteries 2.

This lamp is mounted in series with a choke 3, a switch 4 and a detector 5 of the intensity I of the current traversing the lamp. The detector 5 is connected to a comparator means 6 for comparing the current intensity I to a maximum value *i*M and to a minimum value *im* and for automatically directing the opening of the switch 4 when the maximum value *i*M is obtained and closing this switch when the minimum value *im* is attained such that the current intensity I remains between *im* and *i*M.

Furthermore, a diode 7 is mounted in parallel with the current detector 5, the lamp 1 and the choke 3 and the diode is oriented so as to be conductive in the direction from the negative terminal towards the positive terminal of the direct current source 2.

The operation is the following:

The source 2 has a voltage greater than the arc voltage of the lamp 1. For example, the arc voltage is 140 volts and the source 2 is a battery of 200 volts. If the lamp is a mercury vapor lamp having an energization voltage greater than the voltage of the source, there can be mounted in parallel at the terminals of the lamp a starter or igniter constituted by a choke which delivers at the instant of energization an overvoltage sufficient to ignite the arc.

Once the arc is ignited, the intensity of the current increases. When this intensity reaches *i*M, the switch 4 is opened. At this instant, the choke 3 opposes the decrease of current intensity and acts as an energy reservoir which was charged during the closure of the switch and which is de-energized through the diode 7 while maintaining the arc. When the intensity of the current reaches the lower value *im* the detector 5 controls anew the closure of the switch 4 and the current increases again.

Figure 3:
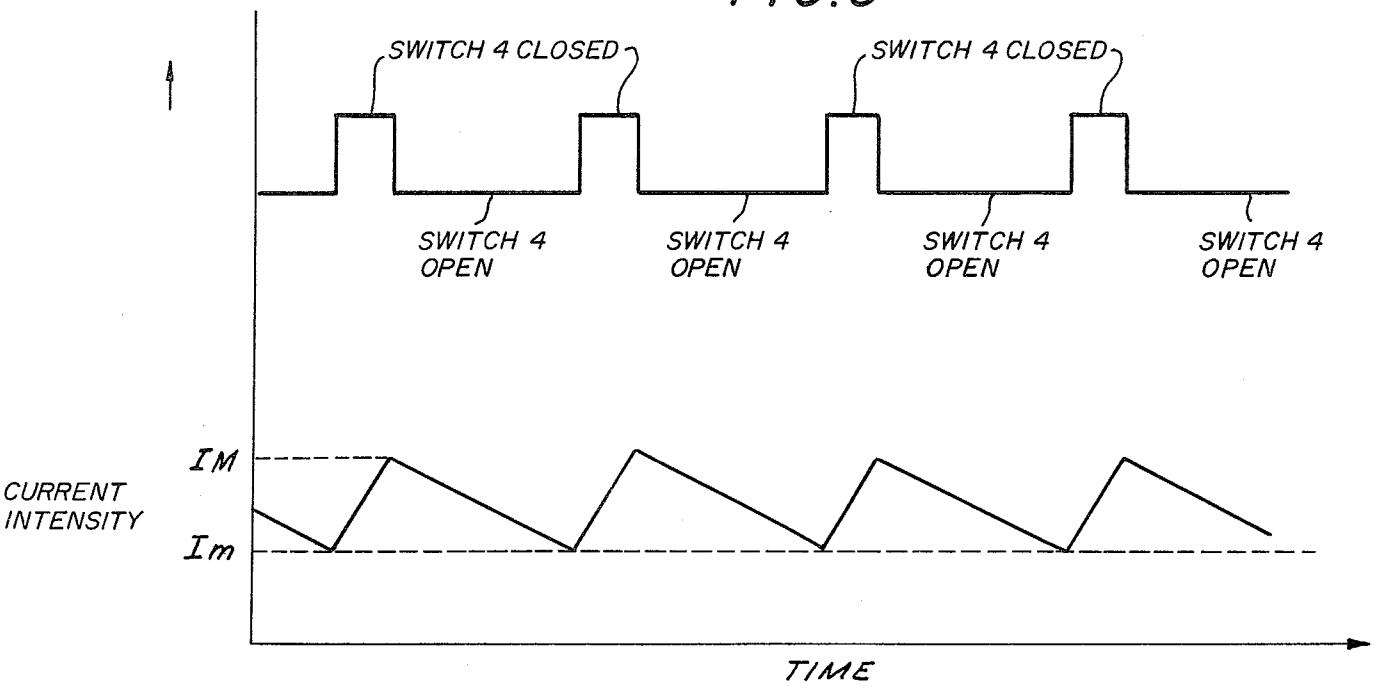
FIG. 3 is a graph showing variations in time of the intensity of the arc current and corresponding positions of a switch.

The time graph in FIG. 3 shows at the top, notches corresponding to the closure of the switch. At the bottom there is shown variations of sawtooth shape of the intensity of the arc current between the values *im* and *i*M. The time of discharge of the choke during which the current decreases can be several times greater than the time during which the battery discharges.

The value $im + iM/2$ which represents the average intensity of the lamp in normal operation is such that the lamp does not risk over heating.

The value $\Delta i = iM - im$ is selected to be less than the value which would produce a stroboscopic effect.

Figure 2:
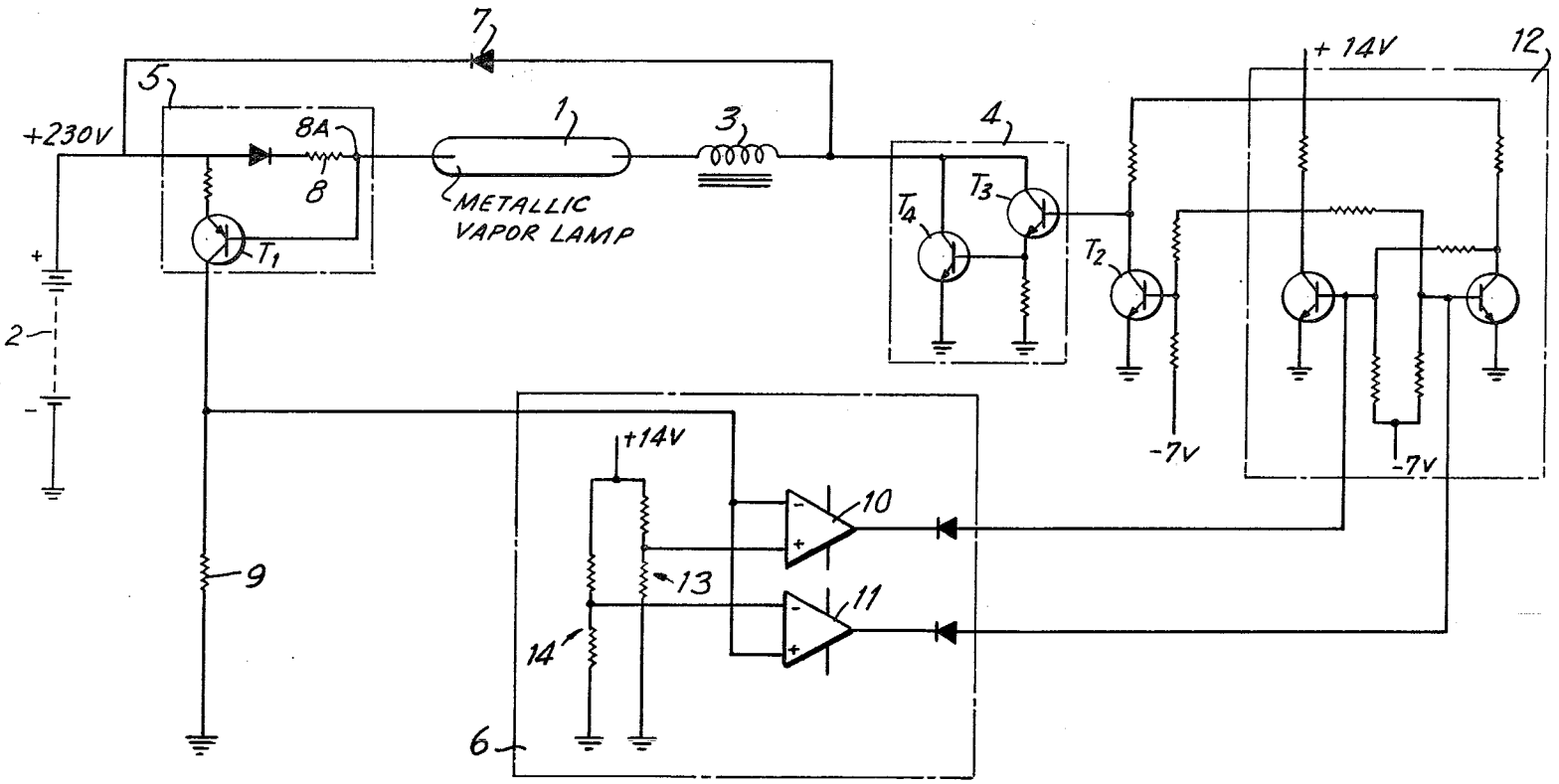
FIG. 2 is a circuit diagram of one embodiment of the apparatus of FIG. 1.

FIG. 2 shows a circuit diagram of one embodiment of the apparatus according to FIG. 1. The same parts are designated by the same numerals.

In this embodiment the current detector 5 is constituted by a resistance 8 of small value, for example, a resistance of 0.2 ohms mounted in series with the lamp 1.

The voltage at the terminal 8A of this resistance, which is proportional to the intensity of the arc current, is applied between the emitter and the base of a transistor T1.

The transistor T1 discharges through a resistor 9 and the voltage at the terminal of this resistor represents analogously the intensity of the arc current. This voltage is fed in parallel to the input terminal of negative polarity of a first comparator 10 and into the input terminal of positive polarity of a second comparator 11. Each of these comparators compares this voltage to a reference voltage obtained by means of dividers 13 and 14.

The comparator 10 delivers at its output a signal of positive polarity exceeding the threshold value when the intensity I of the arc current exceeds the maximum value *i*M.

The comparator 11 delivers a signal of positive polarity at its output when the intensity I of the arc current falls below the minimum value *im*.

The outputs of the two comparators 10 and 11 are connected to the two inputs of a flip-flop 12.

One of the outputs of the flip-flop is connected to the base of a transistor T2 mounted as a switch in a low voltage circuit, for example, a circuit fed with 14 volts which is the feed voltage of electronic circuits.

The transistor T2 controls the voltage applied to the base of a transistor T3 mounted in Darlington relation with a transistor T4. The transistors T3 and T4 form the electronic switch 4 mounted in series with lamp 1. The operation is the following.

When the current intensity is less than the threshold value *im*, the output of the flip-flop 12 is negative. The transistor T2 of NPN type is blocked. The transistors T3 and T4 are saturated and the switch 4 is closed. The current I increases.

When the level *i*M is exceeded, the flip-flop 12 changes state. The output which is connected to the base of the transistor T2 becomes positive and the transistor is saturated.

The transistors T3 and T4 are blocked and the switch 4 is opened.

Of course, without departing from the framework of the invention the various constituent elements of the embodiment which has just been described could be replaced by elements fulfilling equivalent functions.

Notably, the detector of the arc current could be constituted by a photodiode placed in parallel at the terminals of a resistor mounted in series with the lamp, which photodiode lights the base of a photo-transistor which delivers a voltage proportional to the intensity of the current, which voltage is compared by the two amplifiers 10 and 11 to the referenced voltages.

What is claimed is:

1. Power supply apparatus for feeding a discharge lamp comprising a choke and a direct current source mounted in series with the discharge lamp, said apparatus further comprising means for chopping direct current including an electronic switch and a detector of current intensity mounted in series with said choke, first comparator means comparing the intensity of the current to a fixed maximum level from a D.C. source for opening the switch when the maximum level is reached and second comparator means comparing the intensity of the current to a fixed minimum value from a D.C. source for closing the switch when the minimum value is reached such that the intensity of the current always remains between these two values.

2. Apparatus as claimed in claim 1 wherein said lamp, said choke and said current detector are connected in series, said apparatus further comprising a diode mounted in parallel with said lamp, said choke and said current detector and oriented in a direction to pass current from the negative terminal towards the positive terminal of the direct current source.

3. Apparatus as claimed in claim 1 wherein the difference $\Delta i$ between said minimum and maximum values is less than the limit for which a stroboscopic effect would appear.

4. Apparatus as claimed in claim 1 wherein said first second comparator means comprises first and second respective comparators each constituted as an operational amplifier and each having positive and negative input terminals, said current detector being constituted by a resistance of low value mounted in series with said lamp, said resistance having a terminal connected to the positive input terminal of the first comparator and to the negative input terminal of the second comparator, a first reference D.C. voltage means connected to the negative input terminal of the first comparator, and a second reference D.C. voltage means connected to the positive input terminal of the second comparator means, said comparators respectively comparing the voltage at the terminal of said resistance to the voltage of the two reference voltage means.

5. Apparatus as claimed in claim 4 comprising a flip-flop having two inputs each connected to a respective output of a comparator, said electronic switch being constituted by at least one transistor whose base is connected to the output of said flip-flop such that the transistor is blocked according to the polarity of said output.

6. Apparatus as claimed in claim 5 wherein said electronic switch is composed of a plurality of said transistors mounted in Darlington relation in the direct current feed circuit of the lamp, one transistor being mounted as a switch in a polarization circuit of the base of the last transistor of the mounting in Darlington relation whose base is connected to the output of said flip-flop.

7. Apparatus as claimed in claim 1 wherein said discharge lamp is a mercury vapor lamp.

* * * * *